US008087368B2

(12) United States Patent
Raimondo

(10) Patent No.: US 8,087,368 B2
(45) Date of Patent: Jan. 3, 2012

(54) INDICIA AND METHOD FOR PIERCING PATCHWORK QUILTS

(76) Inventor: Paula Raimondo, Morristown, NJ (US)

( * ) Notice: Subject to any disclaimer, the term of this patent is extended or adjusted under 35 U.S.C. 154(b) by 700 days.

(21) Appl. No.: 12/232,938

(22) Filed: Sep. 26, 2008

(65) Prior Publication Data

US 2010/0077951 A1 Apr. 1, 2010

(51) Int. Cl.
*D05B 11/00* (2006.01)

(52) U.S. Cl. ..... 112/475.18; 112/117

(58) Field of Classification Search ..... 112/117, 112/119, 98–101, 475.01, 475.08, 475.18; 40/668, 661.11, 661.12; 24/706, 710.9, 711–711.4; D8/382, 391
See application file for complete search history.

(56) References Cited

U.S. PATENT DOCUMENTS 2,266,432 A * 12/1941 Morin et al. ..... 264/161
2,611,168 A * 9/1952 Light ..... 24/711.4
2,873,708 A * 2/1959 Boltach ..... 112/475.01
4,530,665 A * 7/1985 Colonel ..... 434/95
4,646,666 A * 3/1987 Burrier ..... 112/475.22
4,814,218 A 3/1989 Shane
6,155,189 A * 12/2000 Walner ..... 112/475.01
6,443,081 B1 * 9/2002 Quint ..... 112/475.18
7,866,076 B2 * 1/2011 Roche ..... 40/661.01
2008/0029006 A1 2/2008 Boring

OTHER PUBLICATIONS

Web pages, www.shopfonsandporter.com, Jun. 16, 2008 "Directional Arrow Pin Assortment" and "Directional Arrow Pin Set".

* cited by examiner

*Primary Examiner* — Ismael Izaguirre
(74) *Attorney, Agent, or Firm* — Thomas J. Germinario

(57) ABSTRACT

A series of pattern indicia are detachably affixable to multiple blocks of fabric in accordance with a formatting sequence that encodes an overall decorative pattern of a patchwork quilt top. A method of piecing the blocks to form the quilt top uses the pattern indicia to keep track of the position of each block in the decorative pattern, so that the pattern layout may be disassembled to facilitate sewing the blocks together.

6 Claims, 3 Drawing Sheets

INDICIA AND METHOD FOR PIERCING PATCHWORK QUILTS

BACKGROUND OF THE INVENTION

1. Field of the Invention

The present invention relates to quilted craft articles, and, more particularly, to equipment and methodology for making patchwork quilts that are accessible and practicable for home hobbyists.

2. Background Art

Quilting is deeply engrained as a traditional craft and folk art form in many cultures throughout the world. In America, quilting became a popular craft during the westward migrations of the 19$^{th}$ Century, when quilting circles and quilting bees provided an enjoyable social pastime for women. Handmade quilts, often created as gifts for weddings or births, became family heirlooms, handed down from one generation to another. Such quilts would frequently form a mosaic of the quilter's life by incorporating swatches of material having sentimental value, such as patches from a bridal gown or a baby garment.

Beyond the functionality of the quilt, there is an aesthetic dimension, which offers almost limitless potential for self-expression. Therefore, the decorative patterns and designs according to which elements of the quilt are assembled are of central importance. Because of the strongly traditional character of quilting, new designs often evolve from pre-existing patterns, in the usual manner of folk art. It follows that quilting techniques emphasize both reproducibility and variability as a highly desirable features.

A quilt comprises two or more layers of material joined together by stitching. A typical quilt has three layers: (1) a quilt top, which incorporates a decorative pattern, (2) a middle layer of batting or wadding, which consists of an insulating material, such as cotton or wool, (3) a backing layer, to which the quilt top and the batting are sewn. The quilt top may be patchwork, i.e., comprising multiple pieces of fabric sewn together to make a decorative pattern, or whole-cloth, in which a single piece of fabric has a decorative pattern applied by stitching, appliqué and/or embroidery.

For patchwork quilts, the quilting process comprises six steps: (1) selecting a pattern and materials, (2) cutting pieces of fabric to make the "blocks" that will form the pattern of the quilt top, (3) "piecing" the blocks together to make a finished quilt top, (4) layering the quilt top over the batting and backing, (5) stitching by hand or machine through all three layers, (6) trimming excess batting from the edges and sewing binding to the quilt perimeter.

The present invention concerns itself with the "piecing" step of the quilting process. Piecing involves sewing blocks together to create the overall decorative pattern of the quilt top. The blocks may be whole-cloth, or they make comprise smaller pieces of fabric sewn together. They may be sewn together edgewise or interconnected by strips of cloth called sashing. Blocks typically have geometric shapes, such as squares or rectangles, so that they can laid out in a geometric format, such as a rectilinear grid, to form the overall decorative pattern.

The overall decorative pattern of the quilt top may be formed by the combined effect of the interior patterns of the blocks "flowing" from one block to another. Alternately, the overall pattern may comprise a repetitive sequence of the interior patterns of the blocks. In either case, the position of each block in the overall pattern is of paramount importance, and reliably keeping track of that position during the piecing process is absolutely essential.

In the commercial manufacture of quilts, the blocks can be laid out in the desired overall pattern and kept in the that pattern while a "long-arm" sewing machine moves on tracks over the fabric and sews the layers together. For quilting hobbyists and crafters working at home, however, the initial layout of the blocks must be disassembled in order for pairs of blocks to be hand sewn or passed through a home sewing machine. Therefore, the craft quilter needs a method that tracks the position of each block in the overall pattern after the initial layout has been disassembled.

For a large quilt comprising 500 or more blocks, keeping track of the position of each block in the overall pattern presents a difficult problem. The prior art has attempted to address this problem by employing templates. Shane, U.S. Pat. No. 4,814,218, teaches the use of a numbered pattern template with a correspondingly numbered paper pattern. The numbered paper pattern is used to cut pieces having a color and/or pattern that matches the numbered position on the template. The position of each piece in the overall design is established not by any indicia on the pieces themselves, but by the numbered slits on the template into which the pieces are inserted.

Similarly, the published patent application of Boring, Pub. No. US 2008/0029006, discloses a method for making an appliqué that uses a numbered pattern template along with a correspondingly numbered paper pattern. Using the paper pattern, pieces are cut out and numbered in accordance with the positions on the pattern template to which they are to be applied.

Neither Shane nor Boring, however, teaches a sewing method of piecing a patchwork quilt top. In Shane, the pieces inserted into the template cannot be sewn together, but instead must be held together by the template. Similarly, in Boring the pieces comprise appliqué that adhesively attaches to the template. At the end of both of these processes, the template remains an integral part of the quilt/appliqué. Hence, the Shane and Boring methodologies cannot be applied to traditional quilting techniques, in which the blocks must be sewn together independent of any template backing.

Both Shane and Boring also have the disadvantage of limiting the quilter's creativity by forcing her/him to follow a prescribed template in order to practice these inventions. If the quilter wishes to deviate from the template pattern or create a new pattern, she/he is compelled to undertake the onerous and time-consuming task of making an entirely new template. Consequently, while the template methodologies may be useful for beginning quilters, they are inappropriate for experienced quilters who have the desire and skill to expand upon pre-existing decorative patterns.

The present invention dispenses with the need for a tangible pattern template by employing a series of pattern indicia that are detachably affixed to each of the blocks in accordance with a formatting sequence that encodes the overall decorative pattern of the quilt top. The formatting sequence of the pattern indicia is such that it can be mentally visualized without the need for a physical template. As applied to a typical rectilinear grid pattern of a patchwork quilt, for example, the pattern indicia could comprise column and row numbers, such that the pattern indicia "D15" might represent "the 15$^{th}$ row in the 4$^{th}$ column". Thus, after the pattern indicia are affixed to each block, the rectilinear layout of the blocks can be reproduced without reference to a physical template.

Another advantage of the present invention over the prior art is that the pattern indicia are reusable and are adaptable to virtually any type of overall decorative pattern. The pattern indicia can take the convenient form of a flat-head pin, with the indicia inscribed on the head. While the use of indiciabearing pins is known in the quilting craft in the form of "directional arrow" pins, such pins do not keep track of the positions of individual quilt pieces, but rather indicate the direction in which the piece is to be oriented so that its internal pattern fits into the overall decorative pattern of the quilt top.

SUMMARY OF THE INVENTION

An object of the present invention is to provide a series of detachable indicia and a method of using same that allows the blocks of a patchwork quilt top to be assembled in a predetermined order without the use of physical templates or "long-arm" sewing machines.

Another object of the present invention is to provide a series of detachable indicia for configuring the blocks of a patchwork quilt top which can be used to create any overall decorative pattern that can be broken down into a geometric format.

A further object of the present invention is to provide a series of quilt-piecing indicia that are inexpensive, readily attachable and detachable, easy to read, and simple to use.

Yet another object of the present invention is to provide a method of piecing a patchwork quilt top that facilitates both reproductions of and variations upon pre-existing overall decorative patterns.

These and other beneficial objectives are achieved by a series of detachable pattern indicia that can be affixed to each of a sequence of blocks comprising a patchwork quilt top. The pattern indicia are used to encode the position of each block in a selected overall decorative pattern of the patchwork quilt top. The pattern indicia preferably are embodied in straight pins having a flat, molded plastic top head, upon which numbers and/or letters are inscribed. Optionally, the pattern indicia can include shapes, colors and symbols as well as numbers and letters.

The method of piecing the blocks of a patchwork quilt using the detachable pattern indicia in accordance with the present invention comprises the steps of: (i) assembling a layout of multiple blocks in the selected overall decorative pattern, (ii) analyzing the decorative pattern to determine its underlying geometric format, such as rectilinear grid, spiral, concentric, etc., (iii) determining a formatting sequence of the pattern indicia needed to encode the underlying geometric format of the decorative pattern, (iv) affixing one or more of the pattern indicia to each block in accordance with the determined formatting sequence, (v) disassembling the layout of blocks so that the blocks may be manipulated for sewing, and (vi) sewing the blocks together in accordance with the formatting sequence.

DETAILED DESCRIPTION OF THE PREFERRED EMBODIMENT

Figure 1:
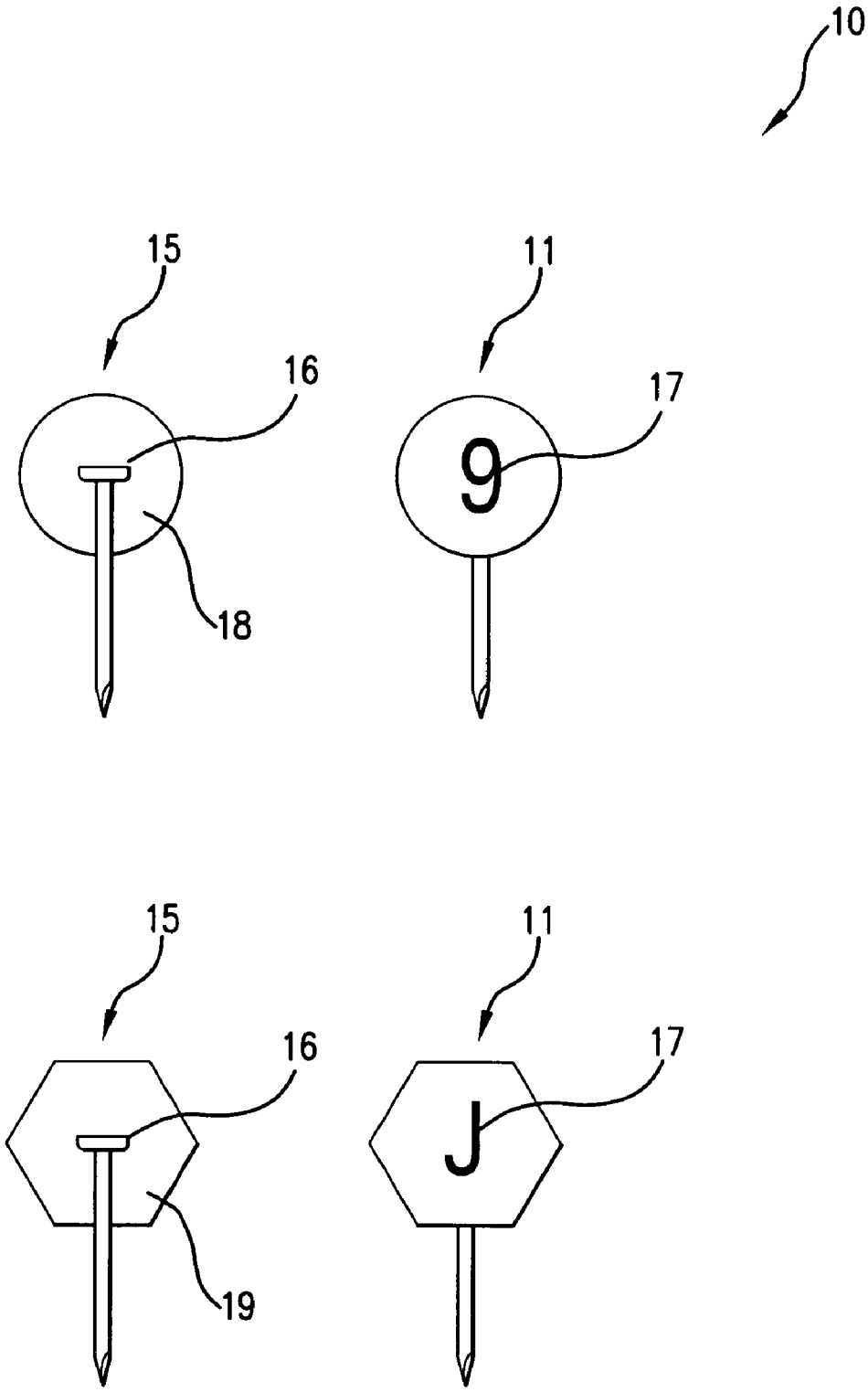
FIG. 1 is a front and rear elevation view of each of two different types of flat-head pins that comprise detachable pattern indicia in accordance with the preferred embodiment of the present invention.
Figure 2:
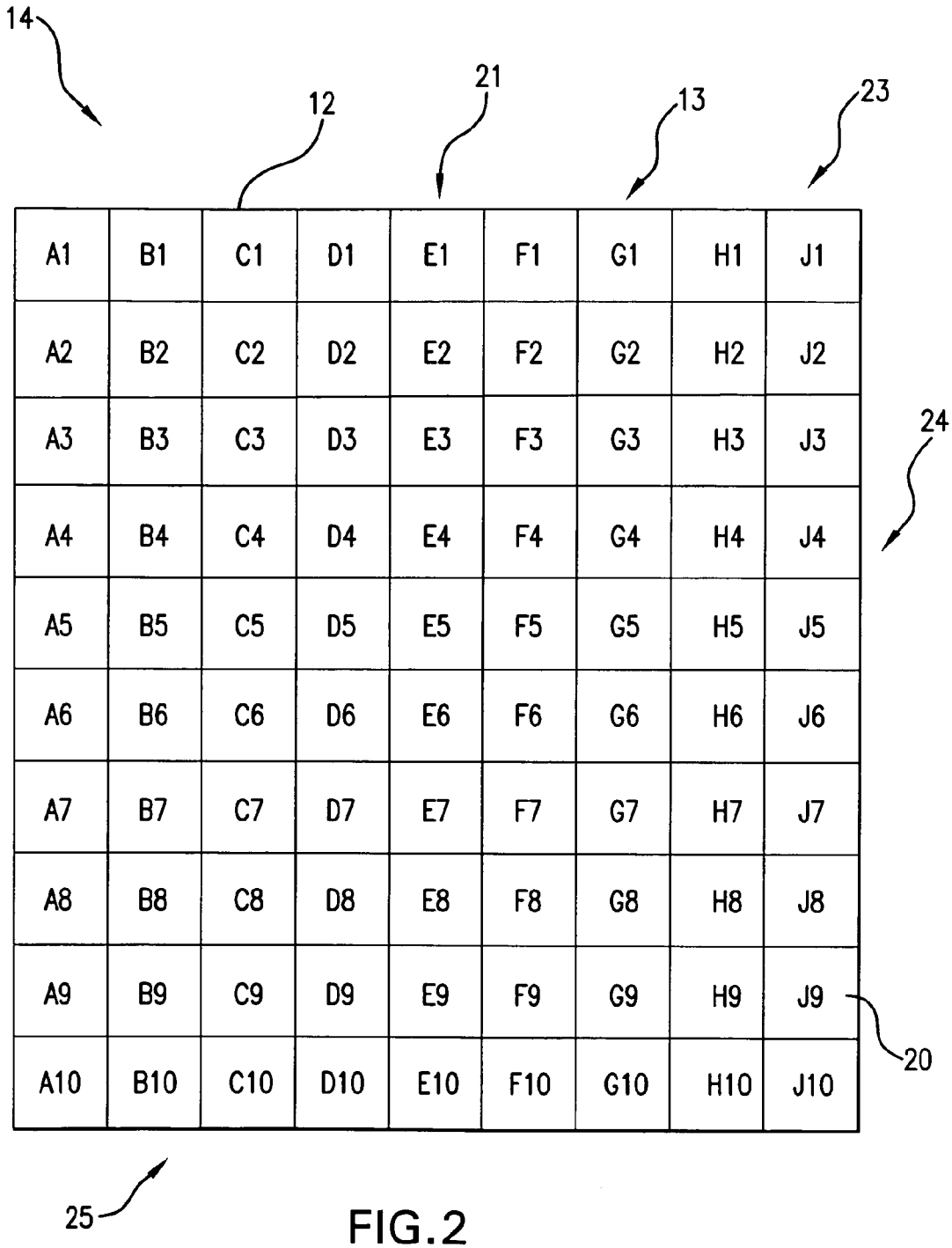
FIG. 2 is a schematic diagram of an exemplary rectilinear formatting sequence for square blocks comprising a decorative pattern of a quilt top in accordance with the preferred embodiment of the present invention.
Figure 3:
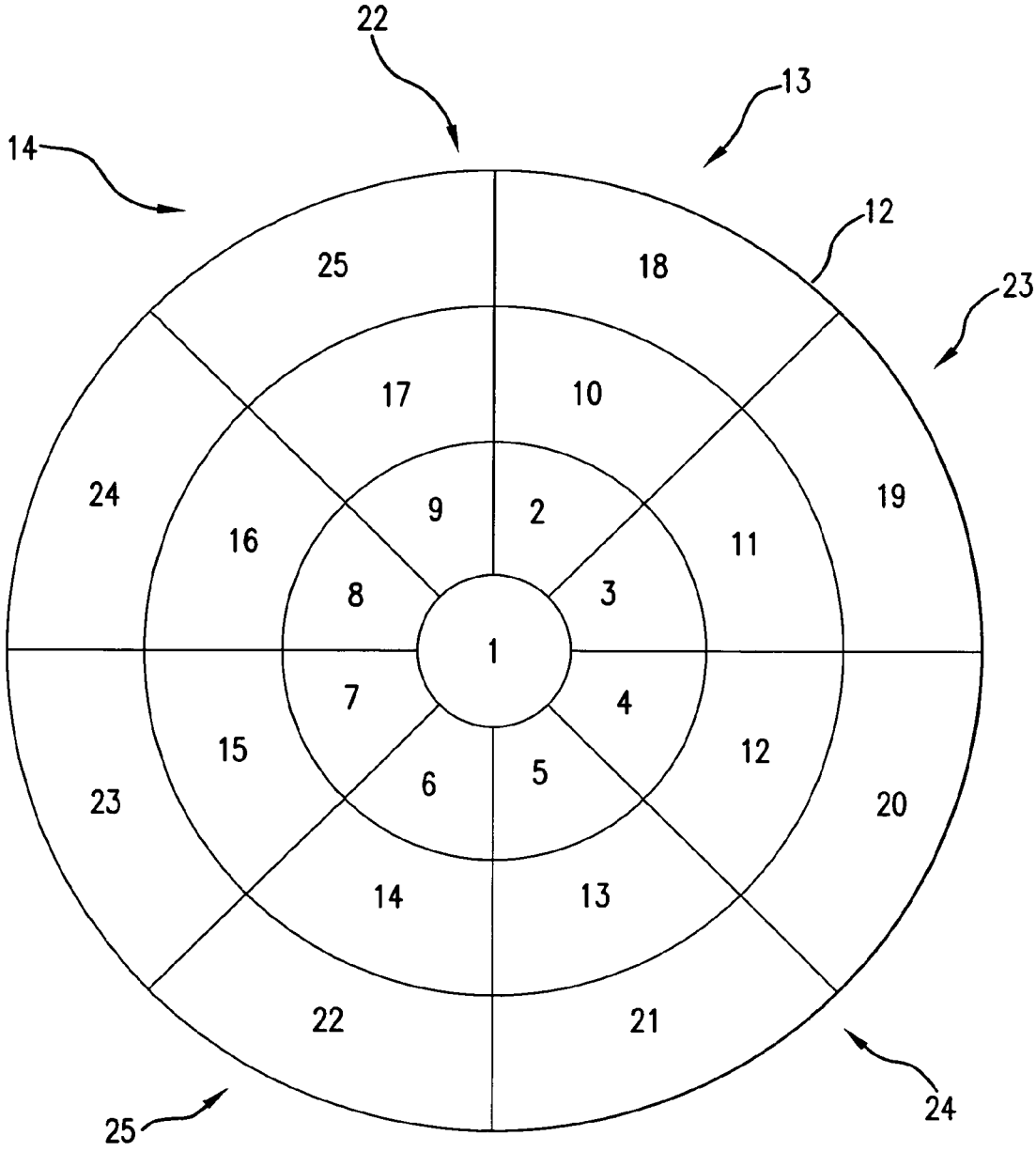
FIG. 3 is a schematic diagram of an exemplary concentric formatting sequence for arcuate blocks comprising a decorative pattern of a quilt top in accordance with the preferred embodiment of the present invention.

As depicted in FIGS. 1-3, in the preferred embodiment of the present invention 10, a series of detachable pattern indicia 11 are affixed to each of a sequence of blocks 12 comprising a patchwork quilt top 13. The pattern indicia 11 are used to encode the position of each block in a selected overall decorative pattern 14 of the patchwork quilt top 13. The pattern indicia 11 preferably are embodied in straight pins 15 having at the top a flat, molded plastic pin head 16, upon which numbers and/or letters 17 are inscribed.

Optionally, the pattern indicia 11 can include shapes, colors and symbols as well as numbers and letters. For example, FIG. 1 depicts both a circular pin head 18 and a hexagonal pin head 19, such that the circular pin head 18 might designate a row, while the hexagonal pin head might designate a column in a formatting sequence 25. Hence, in this example, the two pins of FIG. 1 together would designate "row 9 in column J", or position "J9" 20 in the exemplary rectilinear formatting sequence 21 depicted in FIG. 2.

While a rectilinear formatting sequence can utilize a dual indicia sequence 21 as shown in FIG. 2, a concentric formatting sequence 22, as depicted in FIG. 3, can use a single indicia format based on clockwise sequencing from the center.

The method of piecing the blocks 12 of a patchwork quilt top 13, using the detachable pattern indicia 11 in accordance with the present invention 10, comprises the steps of: (i) assembling a layout 23 of multiple blocks 12 in the selected overall decorative pattern 14, (ii) analyzing the decorative pattern 14 to determine its underlying geometric format 24, such as rectilinear grid, spiral, concentric, etc., (iii) determining a formatting sequence 25 of the pattern indicia 11 needed to encode the underlying geometric format 24 of the decorative pattern 14, (iv) affixing one or more of the pattern indicia 11 to each block 12 in accordance with the determined formatting sequence 25, (v) disassembling the layout 23 of blocks so that the blocks 12 may be manipulated for sewing, and (vi) sewing the blocks 12 together in accordance with the formatting sequence 25.

While this invention has been described with reference to a specific embodiment, the description is not to be construed in a limiting sense. Various modifications of the disclosed embodiment, as well as other embodiments of the invention, will be apparent to persons skilled in the art upon reference to this description. It is therefore contemplated that the appended claims will cover any such modifications or embodiments that fall within the true scope of this invention.

What is claimed is:

1. A method of piecing together multiple blocks of fabric to form a specific decorative pattern of a patchwork quilt top, comprising the steps of:

(a) providing a series of pattern indicia that are detachably affixable to the blocks, (b) assembling a layout of the blocks in the decorative pattern, (c) analyzing the decorative pattern to determine its underlying geometric format, (d) determining a formatting sequence of the pattern indicia needed to encode the underlying geometric format of the decorative pattern, (e) affixing one or more of the pattern indicia to each block in accordance with the determined formatting sequence, (f) disassembling the layout of blocks so that the blocks may be manipulated for sewing, and (g) sewing the blocks together in accordance with the formatting sequence.

2. The method according to claim 1, further comprising two additional steps between step (a) and step (b):

(a1) providing multiple affixing means, by which the pattern indicia are detachably secured to the blocks while the blocks are being sewn together to make the patchwork quilt top, (a2) providing multiple display means that are attached to or part of the affixing means, wherein each display means has one or more markings, colors and/or shapes that represent(s), alone or in combination with the display means of other pattern indicia in the series, the position of the block in the decorative pattern.

3. The method according to claim 1, further comprising two additional steps between step (a) and step (b):

(a1) providing multiple affixing means, each consisting of a straight pin having a top pin head, by which the pattern indicia are detachably secured to the blocks while the blocks are being sewn together to make the patchwork quilt top, (a2) providing multiple display means that are attached to or part of the affixing means, wherein each display means has one or more markings, colors and/or shapes that represent(s), alone or in combination with the display means of other pattern indicia in the series, the position of the block in the decorative pattern.

4. The method according to claim 1, further comprising two additional steps between step (a) and step (b):

(a1) providing multiple affixing means, each consisting of a straight pin having a top pin head, by which the pattern indicia are detachably secured to the blocks while the blocks are being sewn together to make the patchwork quilt top, (a2) providing multiple display means that are attached to or part of the top pin head of the straight pin, wherein each display means has one or more markings, colors and/or shapes that represent(s), alone or in combination with the display means of other pattern indicia in the series, the position of the block in the decorative pattern.

5. The method according to claim 1, further comprising two additional steps between step (a) and step (b):

(a1) providing multiple affixing means, each consisting of a straight pin having a top pin head, by which the pattern indicia are detachably secured to the blocks while the blocks are being sewn together to make the patchwork quilt top, (a2) providing multiple display means, each of which has a back surface that is attached to the top pin head of the straight pin and a front surface that has one or more markings, colors and/or shapes that represent(s), alone or in combination with the display means of other pattern indicia in the series, the position of the block in the decorative pattern.

6. The method according to claim 1, further comprising two additional steps between step (a) and step (b):

(a1) providing multiple affixing means, each consisting of a straight pin having a top pin head, by which the pattern indicia are detachably secured to the blocks while the blocks are being sewn together to make the patchwork quilt top, (a2) providing multiple display means made of molded plastic, each of which has a back surface that is attached to the top pin head of the straight pin and a front surface that has one or more markings, colors and/or shapes that represent(s), alone or in combination with the display means of other pattern indicia in the series, the position of the block in the decorative pattern.

* * * * *